US009950524B2

(12) United States Patent
Shinkai et al.

(10) Patent No.: US 9,950,524 B2
(45) Date of Patent: Apr. 24, 2018

(54) PZT-FILM LAMINATED STRUCTURE, LIQUID DISCHARGE HEAD, LIQUID DISCHARGE DEVICE, LIQUID DISCHARGE APPARATUS, AND METHOD OF MAKING PZT-FILM LAMINATED STRUCTURE

(71) Applicants: Masaru Shinkai, Kanagawa (JP); Yoshikazu Akiyama, Kanagawa (JP); Satoshi Mizukami, Kanagawa (JP)

(72) Inventors: Masaru Shinkai, Kanagawa (JP); Yoshikazu Akiyama, Kanagawa (JP); Satoshi Mizukami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/389,731

(22) Filed: Dec. 23, 2016

(65) Prior Publication Data

US 2017/0197415 A1 Jul. 13, 2017

(30) Foreign Application Priority Data

Jan. 7, 2016 (JP) ..... 2016-001789

(51) Int. Cl.
*B41J 2/14* (2006.01)

(52) U.S. Cl.
CPC .. *B41J 2/14233* (2013.01); *B41J 2002/14241* (2013.01); *B41J 2202/03* (2013.01)

(58) Field of Classification Search
CPC . B41J 2/14233; B41J 2002/02; B41J 2/14241
See application file for complete search history.

(56) References Cited

U.S. PATENT DOCUMENTS

2005/0162047 A1* 7/2005 Torii ..... B41J 2/161 310/358
2008/0218559 A1* 9/2008 Fujii ..... B41J 2/14233 347/68
2011/0090289 A1 4/2011 Mizukami
2012/0212545 A1 8/2012 Mizukami et al.
2012/0229573 A1 9/2012 Mizukami et al.
2012/0236083 A1 9/2012 Mizukami et al.
(Continued)

FOREIGN PATENT DOCUMENTS

JP 61-174116 8/1986
JP 62-036023 2/1987
(Continued)

*Primary Examiner* — Sharon A Polk
(74) *Attorney, Agent, or Firm* — Cooper & Dunham LLP

(57) ABSTRACT

A PZT-film laminated structure includes a substrate, a lower electrode on the substrate, an orientation control layer on the lower electrode, a PZT layer on the orientation control layer, and an upper electrode on the PZT layer. The PZT layer has a (100) or (001) main orientation in which a peak intensity of PZT (100) or (001) is 90% or greater relative to a peak intensity of all PZT peaks in an X-ray diffraction measurement. A ratio of a total value of a secondary ion intensity of Cl relative to a total value of a secondary ion intensity of Ti in the PZT layer is equal to or smaller than 0.03 when the secondary ion intensity of Cl and the secondary ion intensity of Ti in the PZT layer are measured in a direction of thickness of the PZT layer with a magnetic-field secondary ion mass spectrometry.

7 Claims, 11 Drawing Sheets

(56) References Cited

U.S. PATENT DOCUMENTS

| | | | | |
|---|---|---|---|---|
| 2013/0002767 | A1* | 1/2013 | Mizukami ..... | B41J 2/14233 347/68 |
| 2013/0070029 | A1 | 3/2013 | Mizukami et al. | |
| 2013/0162726 | A1 | 6/2013 | Mizukami et al. | |
| 2014/0267509 | A1 | 9/2014 | Shinkai et al. | |
| 2014/0268481 | A1 | 9/2014 | Akiyama et al. | |
| 2014/0340854 | A1 | 11/2014 | Akiyama et al. | |
| 2015/0077475 | A1 | 3/2015 | Mizukami et al. | |
| 2015/0263263 | A1 | 9/2015 | Akiyama et al. | |
| 2015/0266296 | A1 | 9/2015 | Mizukami et al. | |
| 2016/0099402 | A1 | 4/2016 | Mizukami et al. | |
| 2016/0221033 | A1 | 8/2016 | Akiyama et al. | |

FOREIGN PATENT DOCUMENTS

| | | |
|---|---|---|
| JP | 62-246820 | 10/1987 |
| JP | 1-294537 | 11/1989 |
| JP | 8-124798 | 5/1996 |

* cited by examiner

PZT-FILM LAMINATED STRUCTURE, LIQUID DISCHARGE HEAD, LIQUID DISCHARGE DEVICE, LIQUID DISCHARGE APPARATUS, AND METHOD OF MAKING PZT-FILM LAMINATED STRUCTURE

CROSS-REFERENCE TO RELATED APPLICATION

This patent application is based on and claims priority pursuant to 35 U.S.C. § 119(a) to Japanese Patent Application No. 2016-001789 filed on Jan. 7, 2016 in the Japan Patent Office, the entire disclosure of which is hereby incorporated by reference herein.

BACKGROUND

Technical Field

Aspects of the present disclosure relate to a PZT-film laminated structure, a liquid discharge head, a liquid discharge device, a liquid discharge apparatus, and a method of making the PZT-film laminated structure.

Related Art

Recent years, piezoelectric actuators have been increasingly used. As piezoelectric ceramics used as actuator, for example, composite oxides are known that have perovskite crystal structures and can be represented by a chemical formula, $ABO_3$. Among the composite oxides, as a material most generally used for many years, for example, lead zirconate titanate (PZT) is widely known in which lead (Pb) is applied to A and a mixture material of zirconium (Zr) and titan (Ti) is applied o B of the chemical formula, $ABO_3$.

As a method of producing the PZT film, for example, a thick-film method of PZT using green sheet, a sol-gel (SG) method, and a sputtering method are known. In the thick-film method, PZT powder is used as raw material. In the sol-gel method, an organic material containing liquid metal is used as raw material. The organic material is coated on a substrate by, for example, spin coating, spraying, or roll coating to form a film on the substrate, and baked to form a coating film. In the sputtering method, using a ceramic sintered body acting as a target having a predetermined composition, Ar gas or sputtering gas, in which $O_2$ is added to Ar gas, in plasma state is impinged to the target to deposit a piezoelectric film on a substrate. According to the production methods as described above, the PZT film is produced.

However, in each of the production methods, impurities of raw materials are considered to act as disturbance factors to the target functions of the materials. Hence, there is demand for a technique to obtain a PZT film that has a preferable crystal orientation even when produced by, for example, the sol-gel method and achieves a great amount of displacement when used as actuator, regardless of the method of producing the PZT film.

SUMMARY

In an aspect of the present disclosure, there is provided a PZT-film laminated structure that includes a substrate, a lower electrode disposed on the substrate, an orientation control layer disposed on the lower electrode, a PZT layer disposed on the orientation control layer, and an upper electrode disposed on the PZT layer. The PZT layer has a (100) or (001) main orientation in which a peak intensity of PZT (100) or (001) is 90% or greater relative to a peak intensity of all PZT peaks in an X-ray diffraction measurement. A ratio of a total value of a secondary ion intensity of Cl relative to a total value of a secondary ion intensity of Ti in the PZT layer is equal to or smaller than 0.03 when the secondary ion intensity of Cl and the secondary ion intensity of Ti in the PZT layer are measured in a direction of thickness of the PZT layer with a magnetic-field secondary ion mass spectrometry.

In another aspect of the present disclosure, there is provided a liquid discharge head that includes a nozzle substrate, a channel forming substrate, a diaphragm plate, and a piezoelectric thin-film element. The nozzle substrate has a nozzle orifice to discharge liquid. The channel forming substrate includes a pressurization chamber communicated with the nozzle orifice. The diaphragm plate constitutes at least one wall of the pressurization chamber. The piezoelectric thin-film element includes the PZT-film laminated structure disposed on the diaphragm plate.

In still another aspect of the present disclosure, there is provided a liquid discharge device that includes the liquid discharge head.

In still yet another aspect of the present disclosure, there is provided a liquid discharge apparatus that includes the liquid discharge head to discharge the liquid.

In further aspect of the present disclosure, there is provided a method of producing a PZT-film laminated structure. The method includes forming a substrate, forming a lower electrode on the substrate, forming an orientation control layer on the lower electrode, forming a PZT layer on the orientation control layer, and forming an upper electrode on the PZT layer. The forming the PZT layer on the orientation control layer includes forming the PZT layer according to a sol-gel method so that the PZT layer has a (100) or (001) main orientation in which a peak intensity of PZT (100) or (001) is 90% or greater relative to a peak intensity of all PZT peaks in an X-ray diffraction measurement and a ratio of a total value of a secondary ion intensity of Cl relative to a total value of a secondary ion intensity of Ti in the PZT layer is equal to or smaller than 0.03 when the secondary ion intensity of Cl and the secondary ion intensity of Ti in the PZT layer are measured in a direction of thickness of the PZT layer with a magnetic-field secondary ion mass spectrometry.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
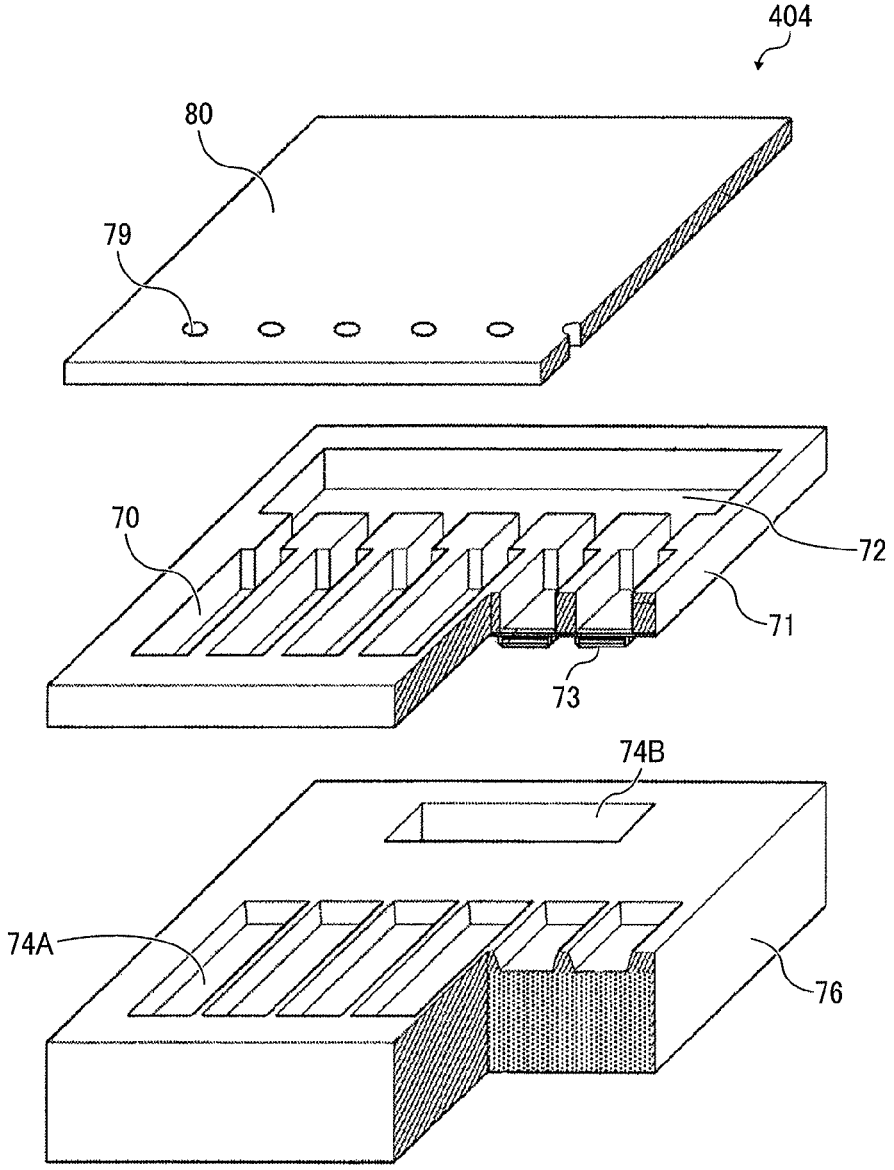
FIG. 1 is an exploded perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Below, a PZT-film laminated structure, a liquid discharge head, a liquid discharge device, a liquid discharge apparatus, and a method of making the PZT-film laminated structure according to embodiments of the present disclosure are described with reference to drawings. Note that the present invention is not limited to the following embodiments and may be other embodiments. The following embodiments may be modified by, e.g., addition, modification, or omission within the scope that would be obvious to one skilled in the art. Any aspects having advantages as described for the following embodiments according to the present invention are included within the scope of the present invention.

According to at least one embodiment of the present disclosure, a PZT-film laminated structure includes a substrate, a lower electrode, an orientation control layer, a PZT film, and an upper electrode. The lower electrode is disposed on the substrate. The orientation control layer is disposed on the lower electrode. The PZT film is disposed on the orientation control layer. The upper electrode is disposed on the PZT film. In an X-ray diffraction measurement, the PZT film is mainly (100) or (001) oriented in which the peak intensity of PZT (100) or (001) is 90% or greater relative to the entire peak of PZT. When the secondary ion intensity of Cl and Ti in the PZT film is measured in the thickness direction of the PZT film with a magnetic-field secondary ion mass spectrometry (SIMS), the ratio of the total value of the secondary ion intensity of CL to the total value of the secondary ion intensity of Ti is 0.03 or lower.

When a PZT material being a powder of an $ABO_3$-type composite oxide is formed in a state of powder, contamination of chlorine causes a mutual fusion phenomenon of fine particles and crystal strain occurs in fine particles obtained by re-pulverization mixing. However, when PZT is formed from a metal alkoxide by, in particular, sol-gel method, there remains unclear about, for example, what disadvantage is caused or how much of chlorine impairs the function of the PZT film.

According to embodiments of the present disclosure, SIMS is used for analysis of a thin film to determine a range in which impurities do not affect the displacement of a mainly (100) or (001) oriented PZT film prepared by, in particular, sol-gel method.

PZT-Film Laminated Structure and Liquid Discharge Head

According to an embodiment of the present disclosure, a PZT-film laminated structure includes a substrate, a lower electrode, an orientation control layer, a PZT film, and an upper electrode. The lower electrode is disposed on the substrate. The orientation control layer is disposed on the lower electrode. The PZT film is disposed on the orientation control layer. The upper electrode is disposed on the PZT film.

According to an embodiment of the present disclosure, a liquid discharge head includes a nozzle substrate, a channel forming substrate, a diaphragm plate, and piezoelectric elements. The nozzle substrate includes nozzle orifices to discharge liquid. The channel forming substrate includes pressurization chambers communicated with the nozzle orifices. The diaphragm plate constitutes at least one wall of each of the pressurization chambers. The piezoelectric elements include the PZT-film laminated structures according to an embodiment of the present disclosure are disposed on the diaphragm plate.

FIG. 1 is an exploded perspective view of the liquid discharge head according to an embodiment of the present disclosure. In FIG. 1, a plurality of nozzle orifices 79, a nozzle substrate 80, a plurality of pressurization chambers 70 (also referred to as cavities), a channel forming substrate 71, a common liquid chamber 72, a diaphragm plate 11 (also referred to as a film-forming diaphragm plate), and a plurality of piezoelectric thin-film elements 73. A sub frame 76 including actuator clearances 74A are also illustrated in FIG. 1.

The liquid discharge head 404 according to the present embodiment includes the plurality of piezoelectric thin-film elements 73 and the plurality of pressurization chambers 70. The liquid discharge head 404 according to the present embodiment includes the common liquid chamber 72 communicated with the plurality of pressurization chambers 70.

The channel forming substrate 71 includes the pressurization chambers 70 and the common liquid chamber 72 and is bonded to the sub frame 76 including the actuator clearances 74A in which the piezoelectric thin-film elements 73 are incorporated and can be driven. The sub frame 76 includes an ink channel 74B. When the sub frame 76 is bonded to the channel forming substrate 71, the ink channel 74B is connected to the common liquid chamber 72.

The nozzle substrate 80 including the plurality of nozzle orifices 79 is bonded to the channel forming substrate 71. When the nozzle substrate 80 is bonded to the channel forming substrate 71, the nozzle orifices 79 are disposed at positions corresponding to the respective pressurization chambers 70. The piezoelectric thin-film elements 73 including PZT-film laminated structures 200 according to an embodiment of the present disclosure generate pressure in the pressurization chambers 70 to discharge liquid from the nozzle orifices 79.

Figure 2:
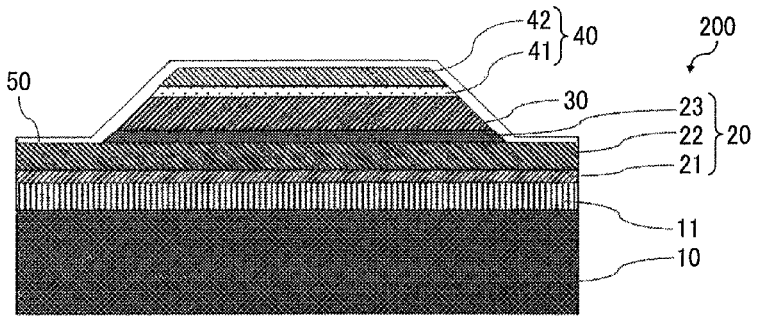
FIG. 2 is a cross sectional view of an example of a piezoelectric element having a PZT-film laminated structure according to an embodiment of the present disclosure.
Figure 3:
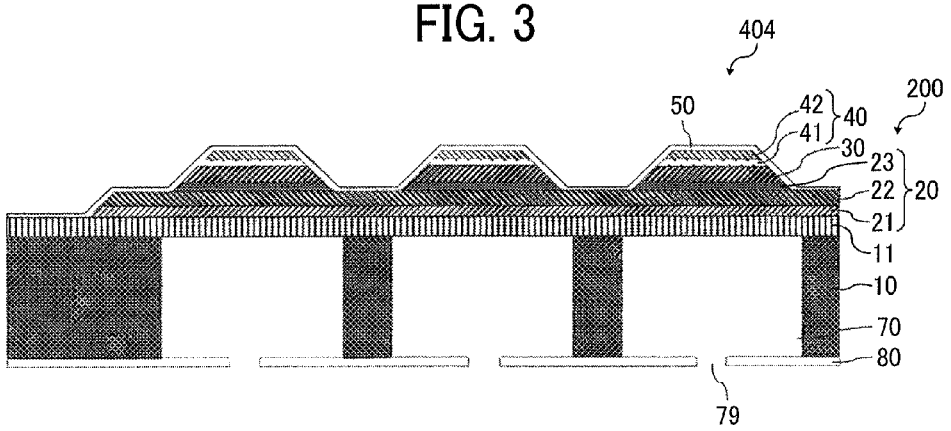
FIG. 3 is a perspective view of an example of a liquid discharge head according to an embodiment of the present disclosure.

The PZT-film laminated structure according to an embodiment of the present disclosure is described with reference to FIG. 2. The liquid discharge head 404 including the PZT-film laminated structure 200 according to the present embodiment is described with reference to FIG. 3. FIG. 2 and FIG. 3 are schematic views of cross sections of the liquid discharge head.

In FIG. 2, the liquid discharge head 404 includes a substrate 10, a diaphragm plate 11, a base film 20 (including an adhesion layer 21, a lower electrode 22, and an orientation control layer 23), a piezoelectric film (PZT film) 30, an upper electrode 40 (including a conductive oxide layer 41, and an upper electrode layer 42), and a protective layer 50. In FIG. 3, the liquid discharge head 404 also includes the nozzle orifices 79, the nozzle substrate 80, and the pressurization chambers 70.

<Substrate>

A silicon single crystal substrate is preferably used as the substrate 10 and the substrate 10 preferably has a thickness of from 100 μm to 600 μm. As plane orientation, three types of (100), (110), and (111) are known. Generally, the (100) and (111) plane orientations are widely used in semiconductor industries. In the present embodiment, a monocrystalline silicon substrate having (100) plane orientation is mainly used.

In creating the pressurization chambers 70 as illustrated in FIG. 3, a monocrystalline silicon substrate is processed by etching. In such a case, anisotropic etching is typically used as a method of etching.

The anisotropic etching utilizes the property that the etching rate is different between plane orientations of crystal structure. For example, in the anisotropic etching in which a substrate is immersed in an alkaline solution, such as KOH, the etching rate of a (111) plane is about 1/400 of the etching rate of a (100) plane. Accordingly, for the (100) plane orientation, a structure having an inclination of about 54.47° C. can be produced. For the (110) plane orientation, a deep groove can be formed, thus increasing the array density while more reliably maintaining the rigidity. In the present embodiment, a single crystal substrate having the (110) plane orientation can be used. In such a case, however, $SiO_2$ being a mask material may also be etched. The single crystal substrate having the (110) plane orientation is preferably used in consideration of the above point.

<Diaphragm Plate>

As illustrated in FIG. 3, receiving the force generated by the piezoelectric film 30, the diaphragm plate 11 deforms and displaces to discharge ink droplets from the pressurization chambers 70. Therefore, the diaphragm plate 11 preferably has a certain degree of strength. Note that the diaphragm plate 11 may be made of a single material, or a plurality of films made of a plurality of materials may be laminated one on another to form the diaphragm plate 11.

The method of forming the diaphragm plate 11 is, for example, a sputtering method, a combination of a sputtering method and a thermal oxidization method, and a metal organic chemical vapor deposition (MOCVD) method. In the present embodiment, when a plurality of films is laminated one on another, the diaphragm plate 11 is produced by a low pressure CVD (LPCVD) method. Such a film formed by the LPCVD method, which constitutes the diaphragm plate 11, has been generally applied in a semiconductor or micro electro mechanical systems (MEMS) device and is easy to process. Therefore, the film formed by the LPCVD method is preferable in that a new problem of process is not brought. In addition, a stable diaphragm plate can be obtained without using an expensive substrate, such as silicon on insulator (SOI).

For the surface roughness, the diaphragm plate 11 preferably has an arithmetic average roughness of not greater than 4 nm. If the surface roughness is greater than 4 nm, the dielectric strength voltage of a subsequently formed PZT film is very low and leakage may be likely to occur. The material of the diaphragm plate 11 is, for example, polysilicon, silicon oxide film, silicon nitride film, or a combination of the foregoing materials.

An example of the diaphragm plate 11 is described below. First, as a diaphragm-plate constitution film, a silicon oxide film (having a thickness of, for example, 200 nm) is formed by, for example, the LPCVD method (or heat treatment film formation method) in a monocrystalline silicon substrate having the (100) plane orientation. Then, a polysilicon film (having a thickness of, for example, 500 nm) is formed in the monocrystalline silicon substrate. The polysilicon film preferably has a thickness of 0.1 to 3 μm. For the surface roughness, the polysilicon film preferably has an arithmetic surface roughness of not greater than 5 nm. Next, as the diaphragm-plate constitution film, a silicon nitride film is formed by the LPCVD method.

<Base Film>

Next, a description is given of the base film 20 formed on the diaphragm plate 11. As illustrated in FIG. 3, the base film 20 includes the adhesion layer 21, the lower electrode 22, and the orientation control layer 23. The crystallinity of the piezoelectric film 30 depends on particularly the orientation control layer 23.

The adhesion layer 21 does not necessarily need to be a lamination of a plurality of layers. However, for example, when platinum (Pt) is used in the lower electrode 22, the adhesion layer 21 is preferably a lamination of a plurality of layers made of, for example, Ti, $TiO_2$, $Ta_2O_5$, and $Ta_3N_5$, in consideration of the adhesiveness to the diaphragm plate 11. As a method of producing the adhesion layer 21, vacuum film formation, such as a sputtering method or a vacuum vapor deposition method, is generally used.

The film thickness of the base film 20 is preferably 20 to 500 nm, more preferably, 100 to 300 nm. The film thickness of the adhesion layer 21 is preferably 50 to 90 nm. The film thickness of the lower electrode 22 is preferably 140 to 200 nm. The film thickness of the orientation control layer 23 is preferably 5 to 10 nm.

The material of the lower electrode 22 is preferably Pt, which has a high orientation of (111) plane. When the crystallinity of Pt is evaluated by X-ray diffraction, a Pt film having a high peak intensity in (111) plane.

The orientation control layer 23 is formed on the lower electrode 22. The material of the orientation control layer 23 is preferably, for example, titanium oxide or lead titanate. A titanium oxide film is preferable in that the titanium oxide film reacts to PZT of the sol-gel liquid laminated on the titanium oxide film to form a PZT film that is rich in Ti. Such a Ti-rich titanium oxide film acts as a crystal source of PZT (100) and can form a (100) or (001) main orientation of the PZT film laminated on the titanium oxide film.

The material of the orientation control layer 23 may be directly lead titanate instead of the titanium oxide film. Lead titanate is preferable in that lead titanate acts as a crystal source of PZT (100) and can form a (100) or (001) main orientation of the PZT film laminated on the titanium oxide film.

<PZT Film>

Next, a description is given of the piezoelectric film (PZT film) 30 according to the present embodiment. PZT is a solid solution of lead zirconate ($PbTiO_3$) and titanium acid ($PbTiO_3$) and has a characteristic different according to the ratio of the lead zirconate ($PbTiO_3$) and the titanium acid ($PbTiO_3$). When the ratio of $PbZrO_3$ and $PbTiO_3$ is 53:47, the PZT film 30 has a generally excellent piezoelectric property. The composition is represented by a chemical formula of $Pb(Zr_{0.53}Ti_{0.47})O_3$, generally, PZT (53/47) An example of a composite oxide other than the PZT is barium titanate. In such a case, barium alkoxide and titanium alkoxide compounds are used as a starting material and are dissolved in a common solvent, to prepare a barium titanate precursor solution.

The materials are represented by a general formula $ABO_3$ and composite oxides including A=Pb, Ba, and Sr, and B=Ti, Zr, Sn, Ni, Zn, Mg, and Nb as main components correspond to the materials. Specific examples of the composite oxides include $(Pb_{1-x}, Ba_X)(Zr_{1-Y}, Ti_Y)O_3$ and $(Pb_{1-x}, Sr_X)(Zr_{1-Y}, Ti_Y)O_3$, in which a part of Pb at A site is replaced with Ba or Sr. Such substitution is enabled in bivalent element, thus obtaining an effect of reducing characteristic degradation due to the evaporation of lead during heat treatment.

As a producing method, the composite oxides can be produced with a spin coater according to a sputtering method or a sol-gel method. In such a case, for patterning, a desired pattern is obtained by, for example, photolithoetching.

In the present embodiment of the present disclosure, the sol-gel method is preferable. When the PZT film is formed by the sol-gel method, a precursor solution of the PZT film is coated on the orientation control layer 23 and baked to from the PZT film. The PZT film may also be a single layer. However, coating and baking are preferably repeated to form the PZT film. In other words, the coating and baking of the precursor solution are repeated a plurality of times to form the PZT film. In such a case, after the coating and baking of precursor solution are repeated the plurality of times, a further heating step is preferably performed to form the PZT film.

Such process may be referred to as two-step baking. As the baking after spin coating of the sol-gel liquid, two-step baking is preferably performed that includes heating for releasing organic components (first step) and heating at higher temperature for crystallizing the film (second step). The first-step heating is performed for each spin coating. After the first-step heating is performed on each of a second layer and a second layer in the same manner as on the first layer, the three layers are collectively baked at higher temperature at the second step.

When PZT is prepared by the sol-gel method, lead acetate, zirconium alkoxide, and titanium alkoxide compounds are used as starting materials and are dissolved in methoxyethanol functioning as a common solvent and a uniform solution is obtained. Thus, a PZT precursor solution can be prepared. Since a metal alkoxide compound is easily hydrolyzed by atmospheric water, a stabilizer, such as acetylacetone, acetic acid, or dicthanolamine may be appropriately added to the PZT precursor solution. As the above-described alkoxide, methoxyethoxide is preferable. The precursor solution preferably includes lead acetate, methoxyethoxide of ti, and methoxyethoxide of Zr.

When the PZT film is formed on an entire surface of the base substrate, the PZT film is obtained by forming a coating by a solution coating method, such as a spin coating method, and performing each heat treatment of solvent drying, thermal decomposition, and crystallization on the coating. When the coated film is transformed to a crystallized film, the volume of the film contracts. To obtain a crack-free film, the density of the precursor solution is preferably adjusted to obtain a film thickness of not greater than 100 nm by a single step.

The film thickness of the PZT film is preferably 0.5 to 5 μm, more preferably, 1 to 2 μm. If the film thickness is smaller than the above-described range, sufficient displacement may not be generated. If the film thickness is larger than the above-described range, the number of steps would increase to stack many layers, thus increasing the process time.

<<X-Ray Diffraction>>

In an X-ray diffraction measurement, the PZT film in the PZT-film laminated structure according to an embodiment of the present disclosure has a (100) main orientation or a (001) main orientation in which the peak intensity of PZT (100) or the peak intensity of PZT (001) is 90% or greater relative to the peak intensity of all PZT peaks.

Figure 4:
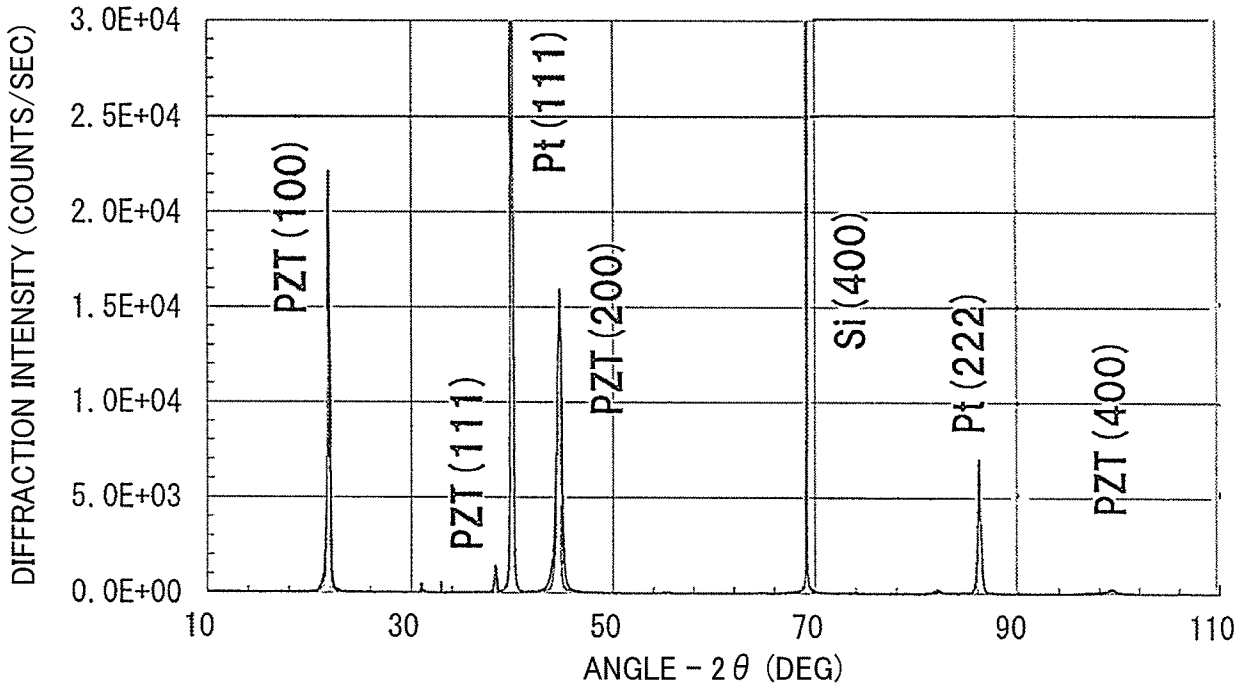
FIG. 4 is a graph of X-ray diffraction data of an example of a PZT film of the PZT-film laminated structure according to an embodiment of the present disclosure.

In the present embodiment, in evaluating the crystal orientation of the PZT film, PZT is formed at a thickness of 2 μm by spin coating with a solution prepared by the sol-gel method and evaluated with an X-ray diffractometer. X-ray diffraction data of an example of the PZT film is illustrated in FIG. 4. In FIG. 4, PZT (100), PZT (111), PZT (200), and PZT (400) are represented.

When the PZT film is measured by X-ray diffraction (XRD), peaks of PZT (111), PZT (100), PZT (101), PZT (110), and PZT (010) occur. Since the PZT film is substantially tetragonal crystal, the peaks of PZT (001) and PZT (100) overlap each other and are difficult to be distinguished in X-ray diffraction. Therefore, in FIG. 4, PZT (100) is represented but PZT (001) may be represented instead of PZT (100). Accordingly, in the present disclosure, the ratio of the peak intensity of PZT (100) or the peak intensity of PZT (001) relative to the peak intensity of all PZT peaks is defined.

In FIG. 4, PZT (200) and PZT (400) are represented. However, since the peaks of PZT (200) and PZT (400) derive from PZT (100), PZT (200) and PZT (400) are considered to be equivalent to PZT (100). Therefore, PZT (200) and PZT (400) may not be considered in determining the above-described ratio of the peak intensity. In other words, when each peak of PZT is represented by PZT (hkl), in the present embodiment, the ratio of the peak intensity is determined in consideration of peaks in which each of h, k, and l is 0 or 1. Note that PZT (200) and PZT (400) are not considered in determining the ratio of the peak intensity, and however, may be considered in examining the crystal strain.

When the total sum of peaks of orientations of PZT (111), PZT (100), PZT (101), PZT (110), and PZT (010) is 1, the ratio of the peak of each orientation is obtained by the following formula. In the following formula, the average orientation degree (orientation rate) is represented by ρ, which is the ratio of the peak intensity of PZT (100) or the peak intensity of PZT (001) relative to the peak intensity of all PZT peaks.

$$\rho = I(hkl)/\Sigma I(hkl)$$

Denominator: total sum of peak intensities

Numerator: peak intensity of a given orientation

Accordingly, in the present disclosure, the denominator is the total sum of peaks of orientations of PZT (111), PZT (100), PZT (101), PZT (110), and PZT (010) and the numerator is the peak intensity of PZT (100) or the peak intensity of PZT (001), from which the ratio of the peak intensity is obtained.

Examining the example illustrated in FIG. 4, the degree of (100) orientation is 90% or greater. For the PZT film, a film quite preferentially oriented in (100) plane is obtain. The degree of PZT (110) orientation (the ratio of the peak intensity of PZT (110) orientation) is preferably not greater than 5%. When the peak intensity of PZT (100) or the peak intensity of PZT (001) is lower than 90% relative to the total sum of intensities of all PZT peaks and the PZT film is used as an actuator, a large amount of displacement would not be obtained and a sufficient property in degradation of displacement after continuous driving would not be obtained.

<<SIMS>>

For the PZT film according to the present embodiment, when the secondary ion intensities of Cl and Ti in the PZT film are measured in the direction of thickness of the PZT film with a magnetic-field-type secondary ion mass spectrometry (SIMS), the ratio of the total value of the secondary ion intensity of Cl to the total value of the secondary ion intensity Ti (the total value of the secondary ion intensity of Cl/the total value of the secondary ion intensity of Ti) is 0.03 or lower.

Chlorine, which derives from a material used to produce the PZT film, is contained in the produced PZT film. If a predetermined amount or greater of chlorine is mixed in the PZT film, crystal strain occurs in the PZT film even when the PZT film has a (100) main orientation or a (001) main orientation. When the PZT film containing the predetermined amount or greater of chlorine is used as the actuator, chlorine would affect the amount of displacement.

In particular, when the PZT film is produced by the sol-gel method, lead acetate, zirconium alkoxide, and a titanium alkoxide compound are often used as start materials of the raw materials of the sol-gel liquid being the precursor solution of the PZT film. If minute amounts of chlorine is contained in the start materials, chlorine is likely to be finally contained in the PZT film. It is considered that chlorine in the raw materials mostly derive from, in particular, zirconium alkoxide.

Chlorine in the raw materials is not constantly kept at the same amount in the PZT film until the preparation of the PZT film is finished. The amount of chlorine in the sol-gel liquid may be different from the amount of chlorine in the PZT film. Chlorine may be removed during the course of preparation of the sol-gel liquid, during coating of the sol-gel liquid by spin coating, and during baking of a film formed by spin coating. Note that, in the course of production of the PZT-film laminated structure, in particular, in the etching process, etching may be performed using chlorine gas. In such a case, chlorine may mix into the PZT film. However, in such a case, since only an etched cross section of the PZT film is exposed, the amount of chlorine mixed into the PZT film is considered to be relatively small and have a little contribution to the total amount of chlorine in the PZT film.

Figure 11:
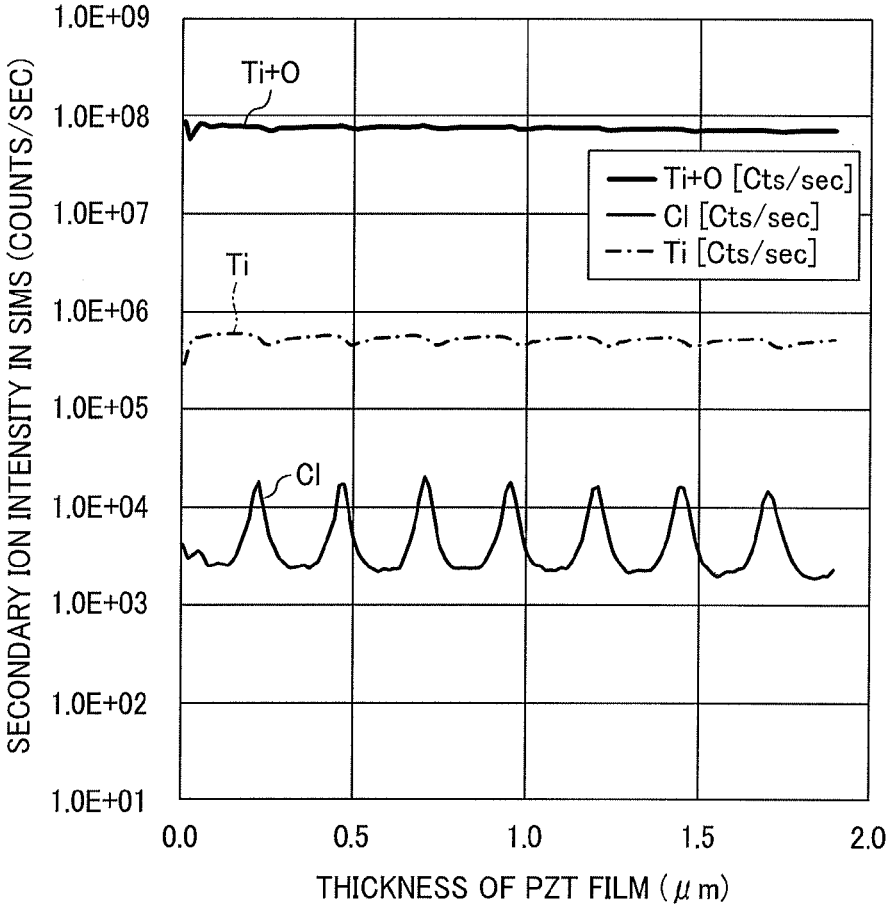
FIG. 11 is a graph of results of SIMS analysis of the PZT film in Example 1.

Hence, through diligent examinations, the inventors of the present application have found that the measurement of a magnetic-field-type SIMS is effective as a method of measuring the amount of chlorine in the PZT film, and have conceived the present invention. Here, when the secondary ion intensity of each element is measured in the direction of thickness of the PZT film with a magnetic-field-type SIMS, in particular, the intensity of chlorine (Cl) varies with the depth of the PZT film. An example of the measurement of the PZT film according to an embodiment of the present disclosure with a magnetic-field-type SIMS is illustrated in FIG. 11. In FIG. 11, the horizontal axis represents the film thickness of the PZT film and the vertical axis represents the secondary ion intensity. As illustrated in FIG. 11, the secondary ion intensity of Cl varies with the position of the thickness of the PZT film.

In the magnetic-filed-type SIMS, atoms are hit against an analysis sample. Then, atomic ions, which constitute the PZT film, exiting from the sample are counted in the direction of depth of the PZT film. For the PZT film in the present embodiment, the secondary ion intensity varies in the thickness of depth of the PZT film. The secondary ion intensity is considered to depend on the composition of raw materials containing chlorine, and also varies with the depth. In other words, in the present embodiment, the PZT film has a configuration in which the amount of atoms constituting the PZT film varies in the direction of depth of the PZT film. Hence, according to the present embodiment, the total value of the secondary ion intensity in the direction of depth is determined as a secondary ion intensity of each element. The ratio of the secondary ion intensity of Cl to the secondary ion intensity of Ti is determined. In the example illustrated in FIG. 11, when the ratio of the secondary ion intensity of Cl to the secondary ion intensity of Ti (the total value of the secondary ion intensity of Cl/the total value of the secondary ion intensity of Ti) is determined from the total value of the secondary ion intensity of Cl and the total value of the secondary ion intensity of Ti in the direction of thickness, the ratio is 0.03 or lower.

Note that a thin-film shaped piezoelectric element can be measured with the SIMS, and the ratio of the secondary ion intensity of Cl to the secondary ion intensity of Ti can be determined for a film produced by not only the sol-gel method but also other producing method, such as the sputtering method. As described above, in a method, such as the sputtering method, other than the sol-gel method, chlorine may also be incorporated into a produced film if chlorine is contained in raw materials of a sputtering target. In a thick-film method of PZT using a green sheet, chlorine may be contained in raw materials of the green sheet or mixed into a film in the course of production. Hence, a piezoelectric film being excellent in the amount of displacement can be obtained by evaluating a produced film with the SIMS measurement.

Note that a thin-film method is a method, such as a sol-gel method, a sputtering method, a chemical vapor deposition (CVD) method, and a vapor deposition method, of forming a functional material on a substrate using a raw material (a material having no piezoelectric properties at a state of raw material) in, normally, vacuum process or wet process. By contrast, the thick-film method is a method having processing steps of mixing an organic binder resin with a powder or granular material (that is constituted as a compound) already constituted as a piezoelectric body, laminating the mixture thick in layers in paste form, and baking the laminated layers. For example, a green sheet construction method used for, e.g. laminated ceramic condenser is included in the thick-film method.

<Upper Electrode>

The upper electrode 40 according to the present embodiment includes the conductive oxide layer 41 and the upper electrode layer 42. Materials of the upper electrode are not limited to specific materials. For example, the upper electrode may be made of materials generally used in a semiconductor process, such as Al or Cu, and a combination of the generally-used materials. Materials of the conductive oxide layer 41 and the upper electrode layer 42 are not limited to specific materials. For example, the material of the conductive oxide layer 41 is preferably SRO ($SrRuO_3$) that has good adhesion to PZT and has a perovskite-type structure similarly with PZT. The material of the upper electrode layer 42 is preferably, for example, Pt. The conductive oxide layer 41 preferably has a thickness of from 35 to 50 nm. The upper electrode layer 42 preferably has a thickness of from 100 to 150 nm.

<Protective Layer>

Materials of the protective layer 50 are, for example, aluminum oxide and tantalum oxide. The protective layer 50 preferably has a thickness of from 40 to 70 nm. The protective layer 50 can be formed by, for example, an atomic layer deposition (ALD) method.

Liquid Discharge Apparatus and Liquid Discharge Device

Figure 5:
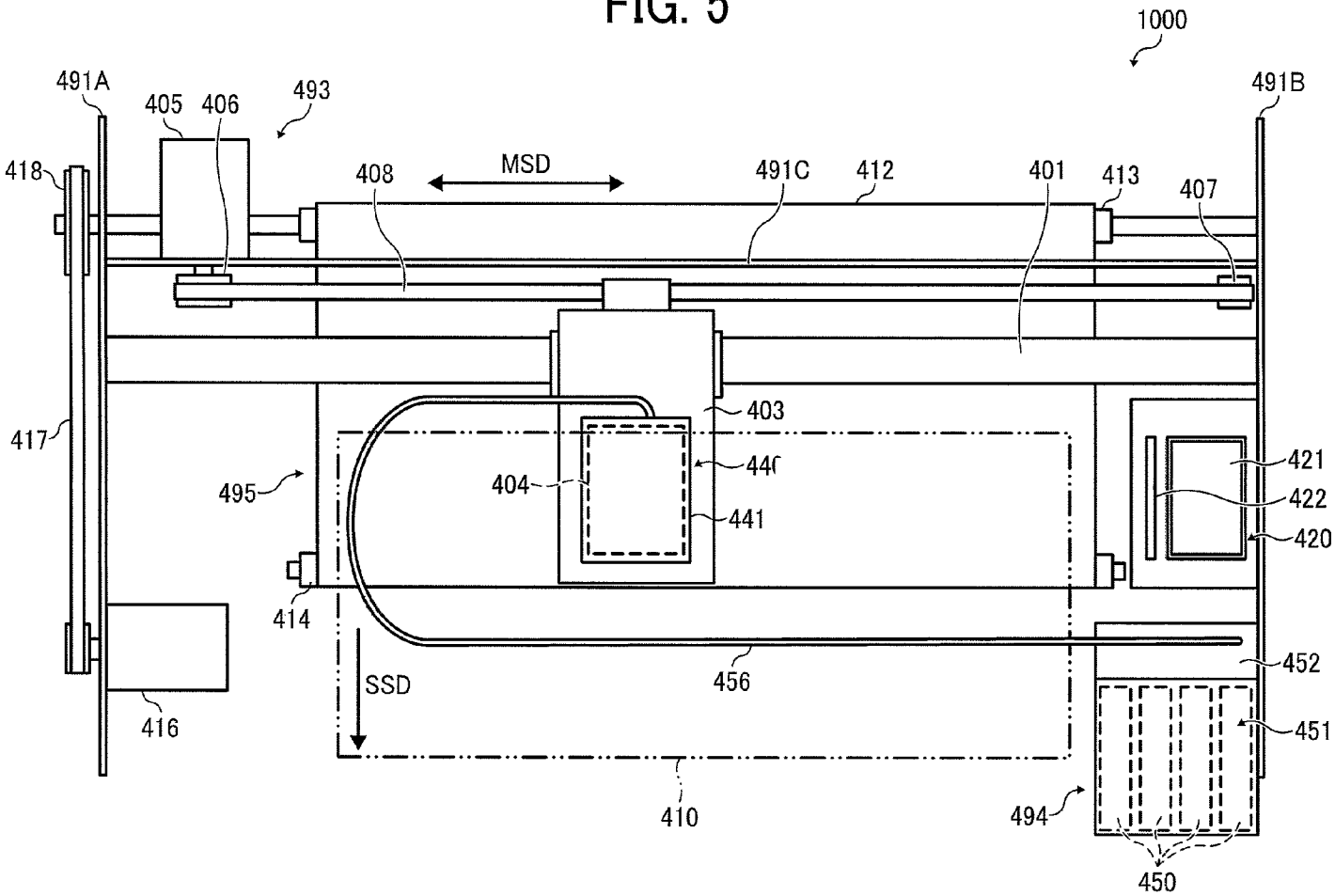
FIG. 5 is a plan view of a liquid discharge apparatus according an embodiment of this disclosure.
Figure 6:
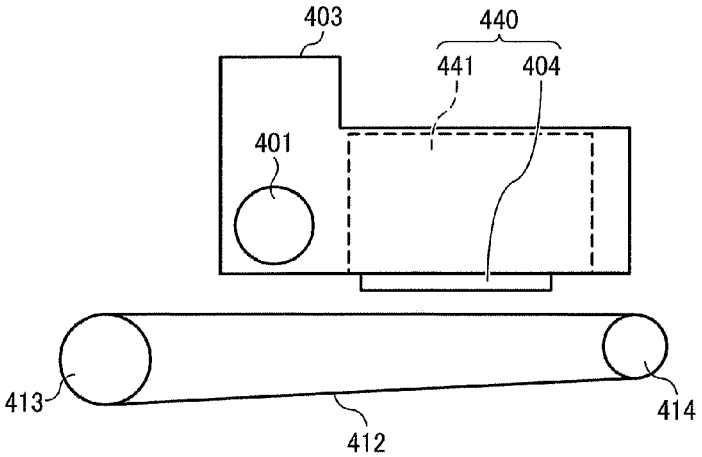
FIG. 6 is a side view of a portion of the liquid discharge apparatus of FIG. 5 including a liquid discharge device.

Next, a liquid discharge apparatus according to an embodiment of the present disclosure is described with reference to FIGS. 5 and 6. FIG. 5 is a plan view of a portion of the liquid discharge apparatus according to an embodiment of the present disclosure. FIG. 6 is a side view of a portion of the liquid discharge apparatus of FIG. 5.

A liquid discharge apparatus 1000 according to the present embodiment is a serial-type apparatus in which a main scan moving unit 493 reciprocally moves a carriage 403 in a main scanning direction indicated by arrow MSD in FIG. 5. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The sheet 410 is attracted to the conveyance belt 412 due to an electrostatic force or by air aspiration.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (a face in which nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 7:
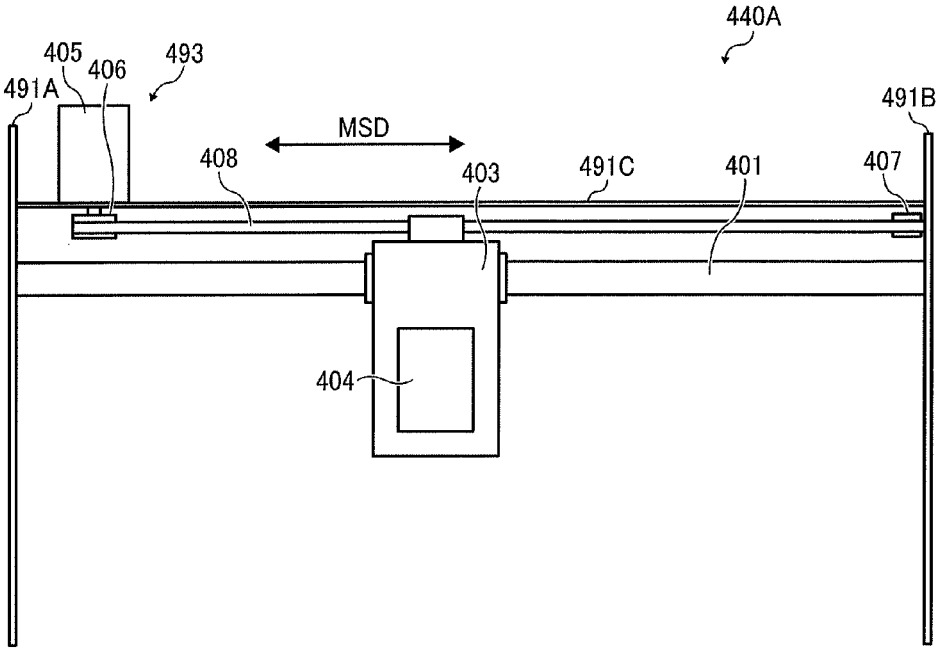
FIG. 7 is a plan view of an example of the liquid discharge device.

Next, another example of the liquid discharge device according to an embodiment of the present disclosure is described with reference to FIG. 7. FIG. 7 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 8:
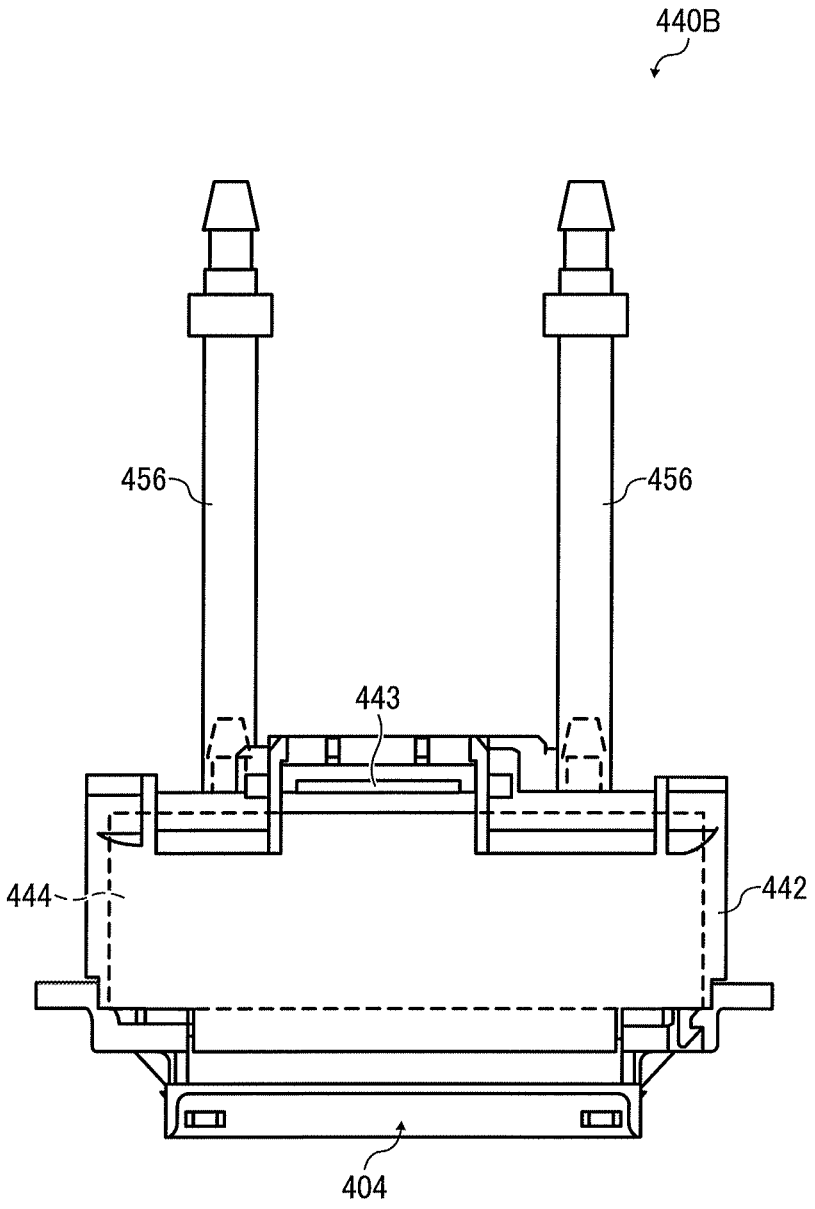
FIG. 8 is a front view of another example of the liquid discharge device.

Next, still another example of the liquid discharge device according to an embodiment of the present disclosure is described with reference to FIG. 8. FIG. 8 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., ink, treatment liquid, DNA sample, resist, pattern material, binder, mold liquid, or solution and dispersion liquid including amino acid, protein, or calcium.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

The liquid discharge apparatus may be, e.g., a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 6. The liquid discharge head and the head tank may be connected each other via, e.g., a tube to form the liquid discharge device as the integrated unit. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. Like the liquid discharge device 440A illustrated in FIG. 11, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 8, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor, or an electrostatic actuator including a diaphragm and opposed electrodes.

The terms "image formation", "recording", "printing", "image printing", and "molding" used herein may be used synonymously with each other.

Figure 9:
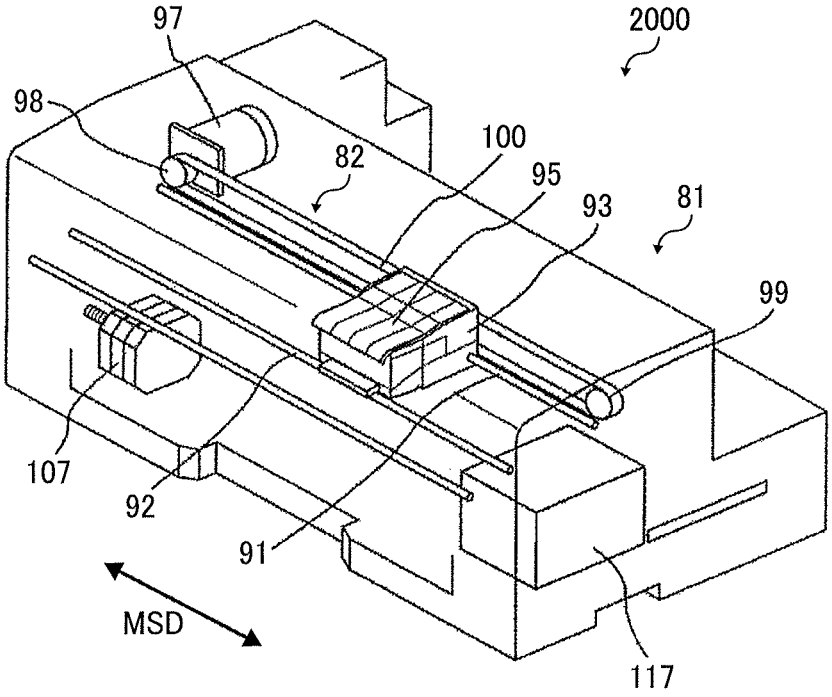
FIG. 9 is a perspective view of the liquid discharge apparatus according to another embodiment of the present disclosure.
Figure 10:
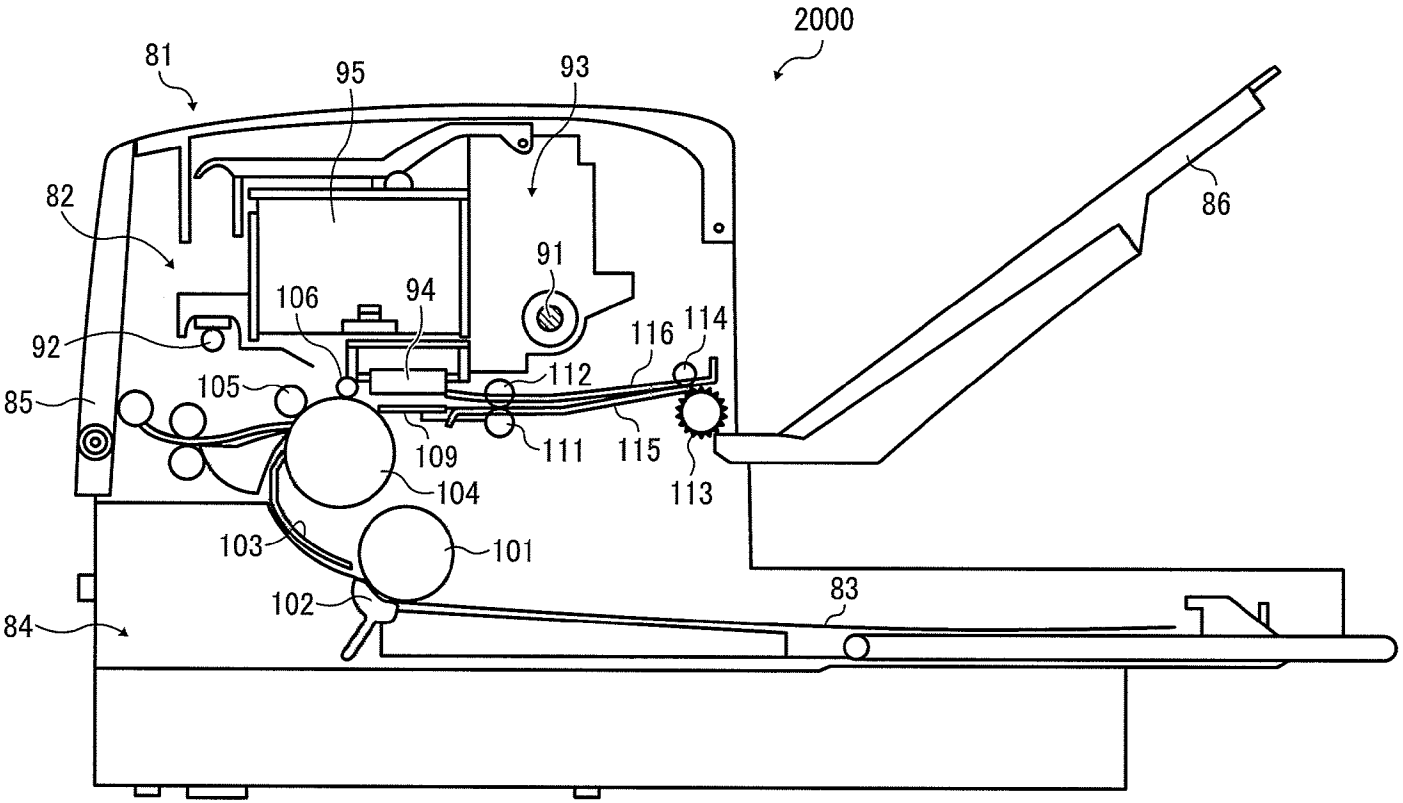
FIG. 10 is a side view of the liquid discharge apparatus according to still another embodiment of the present disclosure.

Next, a liquid discharge apparatus according to an embodiment of the present disclosure is described with reference to FIGS. 9 and 10. In the present embodiment, an inkjet recording apparatus is described as an example of the liquid discharge apparatus. FIG. 9 is a perspective view of an inkjet recording apparatus as an example of the liquid discharge apparatus according to the present embodiment. FIG. 10 is a side view of a mechanical section of the inkjet recording apparatus of FIG. 9.

An inkjet recording apparatus 2000 as an example of the liquid discharge apparatus according to the present disclosure includes, for example, a carriage 93, recording heads 94, and a printing assembly 82 in a recording apparatus body 81. The carriage 93 is movable in the main scanning direction indicated by arrow MSD in FIG. 9. The recording heads 94 are inkjet heads that are liquid discharge heads according to an embodiment of the present disclosure, and are mounted on the carriage 93. The printing assembly 82 includes, for example, ink cartridges 95 to supply ink to the recording heads 94. The inkjet recording apparatus 2000 includes a sheet feeding cassette (or a sheet feeding tray) 84 to stack a large number of sheets 83. The sheet feeding cassette 84 is removably attached to a lower portion of the recording apparatus body 81 from a front side of the recording apparatus body 81. The inkjet recording apparatus 2000 further includes a bypass tray 85 and a sheet ejection tray 86. The bypass tray 85 can be inclined to open to manually feed the sheets 83. When the sheet 83 fed from the sheet feeding cassette 84 or the bypass tray 85 reach the printing assembly 82, the inkjet recording apparatus 2000 records a desired image on the sheet 83 with the printing assembly 82 and ejects the sheet 83 onto the sheet ejection tray 86 attached to a rear side of the inkjet recording apparatus 2000.

The printing assembly 82 supports the carriage 93 with a main guide rod 91 and a sub-guide rod 92 so that the carriage 93 is slidable in the main scanning direction MSD. The main guide rod 91 and the sub-guide rod 92 as guides are laterally bridged between a left side plate and a right side plate. The recording heads 94 are inkjet heads as the liquid discharge heads according to an embodiment of the present disclosure to discharge ink droplets of yellow (Y), cyan (C), magenta (M), and black (Bk). The recording heads 94 are mounted on the carriage 93 in such a manner that a plurality of ink discharge ports (nozzles) is arrayed in rows in a direction perpendicular to the main scanning direction MSD and ink droplets are discharged downward. The ink cartridges 95 to supply ink of the respective colors to the recording heads 94 are replaceably mounted on the carriage 93.

Each of the ink cartridges 95 has an atmosphere communication port, a supply port, and a porous body. The atmosphere communication port is disposed at an upper portion of each ink cartridge 95 to communicate with the atmosphere. The supply port is disposed at a lower portion of each ink cartridge 95 to supply ink to the recording heads 94. The porous body is disposed inside each ink cartridge 95 to be filled with ink. Ink to be supplied to the recording heads 94 is kept at a slight negative pressure by capillary force of the porous body. In this example, the plurality of recording heads 94 is used as the recording heads of the liquid discharge apparatus. However, in some embodiments, a single head having nozzles to discharge different colors of ink droplets may be used as the recording head.

Note that a rear side (a downstream side in a sheet conveyance direction) of the carriage 93 is slidably fitted to the main guide rod 91, and a front side (an upstream side in a sheet conveyance direction) of the carriage 93 is slidably mounted to the sub-guide rod 92. A timing belt 100 is stretched taut between a driving pulley 98, which is driven to rotate by a main scanning motor 97, and a driven pulley 99 to move the carriage 93 for scanning in the main scanning direction MSD. The timing belt 100 is secured to the carriage 93. The carriage 93 is reciprocally moved by forward and reverse rotations of the main scanning motor 97.

The inkjet recording apparatus 2000 further includes a sheet feed roller 101, a friction pad 102, a sheet guide 103, a conveyance roller 104, a conveyance roller 105, and a leading end roller 106 to convey the sheet 83, which is set in the sheet feeding cassette 84, to a portion below the recording heads 94. The sheet feed roller 101 and the friction pad 102 separates and feeds the sheets 83 sheet by sheet from the sheet feeding cassette 84. The sheet guide 103 guides the sheet 83, and the conveyance roller 104 reverses and conveys the sheet 83. The conveyance roller 105 is pressed against a circumferential surface of the conveyance roller 104. The leading end roller 106 defines an angle at which the sheet 83 is fed from the conveyance roller 105 and the conveyance roller 104. The conveyance roller 104 is driven to rotate by a sub-scanning motor 107 via a gear train.

The inkjet recording apparatus 2000 further includes a print receiver 109 disposed below the recording heads 94. The print receiver 109 is a sheet guide to guide the sheet 83, which is fed from the conveyance roller 104, in a range corresponding to a range of movement of the carriage 93 in the main scanning direction MSD. On a downstream side of the print receiver 109 in the sheet conveyance direction, position, the inkjet recording apparatus 2000 includes a conveyance roller 111, a spur roller 112, a sheet ejection roller 113, a spur roller 114, a guide 115, and a guide 116. The conveyance roller 111 is driven to rotate with the spur roller 112 to feed the sheet 83 in a sheet ejection direction. The sheet ejection roller 113 and the spur roller 114 further feed the sheet 83 to the sheet ejection tray 86. The guide 115 and the guide 116 form a sheet ejection path.

In recording, the inkjet recording apparatus 2000 drives the recording heads 94 according to image signals while moving the carriage 93, to discharge ink onto the sheet 83, which is stopped below the recording heads 94, by one line of a desired image. Then, the sheet 83 is fed by a predetermined amount and another line is recorded. When the inkjet recording apparatus 2000 receives a signal indicating that a rear end of the sheet 83 has reached a recording area, the inkjet recording apparatus 2000 terminates a recording operation and ejects the sheet 83.

Further, the inkjet recording apparatus 2000 further includes a recovery device 117 to recover the recording heads 94 from a discharge failure. The recovery device 117 is disposed at a position outside the recording area at a right side in the direction of movement of the carriage 93. The recovery device 117 includes a cap unit, a suction unit, and a cleaning unit. During standby for printing, the carriage 93 is moved toward the recovery device 117 and the recording heads 94 are capped with the cap unit. Thus, discharge ports are maintained in humid state, thus preventing discharge failure due to dry of ink. For example, during recording, the inkjet recording apparatus 2000 discharges ink not relating to the recording to maintain the viscosity of ink in all of the discharge ports constant, thus maintaining stable discharging performance.

When a discharge failure has occurred, the discharge ports (nozzles) of the recording heads 94 are tightly sealed with the cap unit, the suction unit sucks, e.g., ink and bubbles from the discharge ports via tubes, and the cleaning unit removes ink and dust adhered to the surfaces of the discharge ports, thus recovering the discharge failure. The sucked ink is drained to a waste ink container disposed on a lower portion of the recording apparatus body 81, is absorbed into an ink absorber in the waste ink container, and is held in the ink absorber.

The inkjet recording apparatus according to the present embodiment prevents a discharge failure of ink droplets due to a driving failure of the diaphragm plate. Accordingly, stable discharge properties of ink droplet can be obtained, thus increasing the image quality.

EXAMPLES

Below, further examples in the present disclosure are described. However, examples of the present disclosure are not limited to the following examples.

Example 1

<Production of Element>

In the present example, the PZT-film laminated structure 200 illustrated in FIG. 2 was produced. After a thermal oxide film was formed on a surface of the substrate 10 of Si, the lamination-type diaphragm plate 11 is formed by CVD. Specifically, a thermal oxide film (having a film thickness of 600 nm) was formed on a silicon wafer, and a film produced by the LPCVD method was formed on the thermal oxide film. First, a polysilicon film of 200 nm was formed. Then, a silicon oxide film was formed at a thickness of 100 nm. Next, a silicon nitride film was formed at a thickness of 150 nm. Further, a silicon oxide film was formed at a thickness of 150 nm and a silicon nitride film was formed at a thickness of 150 nm. Further, a silicon oxide film was formed at a thickness of 100 nm and a polysilicon film was formed at a thickness of 200 nm. Finally, a silicon oxide film was formed at a thickness of 600 nm. All of the laminated films formed the diaphragm plate 11. Note that, in FIG. 2, the diaphragm plate 11 is illustrated as a single layer.

Next, the base film 20 was formed. First, the adhesion layer 21 of the lower electrode 22 was formed on the CVD-laminated layer being the diaphragm plate 11 in a state of adhering to the CVD-laminated layer. As the method of forming the adhesion layer 21, after forming a metal film of Ti by a sputtering method, oxidization was performed on the metal film in an oxygen atmosphere with a rapid thermal anneal (RTA) apparatus, to form a $TiO_2$ film. As an apparatus of forming the Ti metal film, a sputtering system SME-200 manufactured ULVAC, Inc. was used.

Conditions of formation of the adhesion layer 21 were a substrate temperature of 150° C., a direct current (DC) input power of 300 W, an Ar gas pressure of 0.14 Pa, and a formed film thickness of 50 nm. The metal film of Ti was baked for thermal oxidization for three minutes in an atmosphere of 730° C. (at a temperature rising speed of 30° C./second), a flow amount of oxygen of 1 sccm, and 100% of oxygen. The film thickness of the metal film after baking was 83 to 86 nm.

Next, the Pt electrode as the lower electrode 22 was formed at a film thickness of 160 nm. The degree of vacuum of a process chamber and a delivery chamber before film formation was $1.0\times10^{-5}$ Pa. Process conditions were a substrate temperature of 500° C., a radio frequency (RF) input power of 500 W, and an Ar gas pressure of 0.16 Pa. Thus, in the lower electrode 22, the (111) plane was oriented in the direction of film thickness.

A reason that, in the present example, the metal film of Pt was formed at the thickness of 160 nm is that, since white turbidity was observed in a Pt film having a film thickness of 250 nm or greater when the temperature condition in the formation of the Pt film was 550° C. or higher, a Pt film having the thickness of 160 nm can be produced without white turbidity. A reason that white turbidity was observed is considered that the surface roughness was increased (to an arithmetic average higher Sa of about 15 to about 20 nm). Therefore, 160 nm was selected as a value at which holes were not formed in the lower electrode.

Next, as the orientation control layer 23 on the lower electrode 22, after forming a metal film of Ti by a sputtering method, oxidization was performed on the metal film in an oxygen atmosphere with the RTA apparatus, to form a $TiO_2$ film having a film thickness of 5 nm. Conditions of formation of the $TiO_2$ film were a substrate temperature of 150° C., a DC input power of 300 W, and an Ar gas pressure of 0.14 Pa. The degree of vacuum of the process chamber and the delivery chamber before sputtering was $1.0\times10^{-5}$ Pa.

Next, the piezoelectric film (PZT film) 30 was formed. As piezoelectric materials, generally-used raw materials of PZT (having a composition of Zr/Ti=52/48 after baking and an excess amount of Pb of 15 atomic %) were selected. Alkoxide having metal elements Pb, Zr, and Ti constituting PZT as components was formed as a starting raw material. Note that methoxyethoxide was used as alkoxide.

A sol-gel liquid prepared by the above-described raw materials was coated onto the orientation control layer 23 by spin coating. In solidification baking of a piezoelectric film after spin coating of the first layer, a hot plate and the RTA apparatus were used to bake the piezoelectric film for five minutes in an oxygen atmosphere at temperatures of 350° C. to 500° C. A purpose of the solidification baking is to release organic components from the starting raw material (first baking step).

A second layer and a third layer were baked for solidification in the same manner and further baked for crystallization for three minutes under conditions of temperatures of 670° C. to 750° C. and a flow of gas having a composition of $N_2$:$O_2$=4:3. When the three layers (M=3) were laminated one on another, the film thickness of the piezoelectric film was 250 nm. The lamination of the three layers was repeated in the same manner to form eight layers (M=8). Thus, piezoelectric film 30 having a total film thickness of 2 μm was formed.

After production of the piezoelectric film, the crystallinity of the piezoelectric film was evaluated. Results of the X-ray diffraction were that the peak intensity of PZT (100) was 150 kcps or greater (150 to 200 kcps) and the orientation rate (the ratio of the peak intensity) was 90 to 99%. As the X-ray diffractometer, D8 DISCOVER manufactured by Burker Corporation was used. Results of 2θ measurements were illustrated in FIG. 4. Another sample having the same conditions as the sample at this state were laid away and was subjected to the SIMS analysis. Results of the SIMS analysis were described later.

Next, the upper electrode 40 was formed. For conditions of production, $SrRuO_3$ was formed as the conductive oxide layer 41 at a thickness of 40 nm and a Pt electrode was formed as the upper electrode layer 42 at a film thickness of 100 to 150 nm at a substrate temperature of 300° C. Process conditions were an RF input power of 500 W and an Ar gas pressure of 0.5 Pa.

As the upper electrode 40, a photosensitive resist pattern was formed using the technique of photolithography and the upper electrode 40 was etched by chlorine etching gas to form the upper electrode.

As a pattern portion broader than a ferroelectric pattern and an upper electrode pattern, a photolitho-patterning of the lower electrode was performed with a photosensitive resist. The base film 20 was formed in the same manner as in the formation of the above-described piezoelectric element and the upper electrode.

After formation of the respective electrode patterns, an $Al_2O_3$ film was formed on the surface as the protective layer 50 at a thickness of 60 nm according to an atomic layer deposition (ALD) method.

Thus, the piezoelectric element including the protective layer 50, the upper electrode 40, the piezoelectric film 30, the base film 20, and the diaphragm plate 11 was produced. In addition to such basic element structure, in the piezoelectric element, a wiring electrode pattern electrically connected to the upper electrode and the lower electrode via a contact hole is formed and a lead pattern of a power line for driving the piezoelectric element was formed.

The pressurization chambers 70 was processed at an opposite side of the piezoelectric element via the diaphragm plate 11. First, a photosensitive resist pattern is formed in a shape illustrated in FIG. 3 on an Si substrate side and the Si substrate side was etched to form cavities as the pressurization chambers 70. At this time, the $SiO_2$ film in the diaphragm plate 11 acts as an etching stop layer. Next, the sub frame (holding substrate) 76 was bonded to the processed Si substrate side. Using a photosensitive resist in the same manner, a mask layer was produced on the piezoelectric film 30 side and Inductively coupled plasma (ICP) process was performed. After the ICP processing, the mask layer formed with the photosensitive resist was removed.

The nozzle substrate 80, in which the nozzle orifices 79 corresponding to the pressurization chambers 70 were formed in a stainless steel (SUS) 316 (having a thickness of 50 μm), was bonded to a side of the pressurization chambers 70 opposite the piezoelectric element. Thus, the liquid discharge head (the recording head 94) illustrated in FIGS. 1 and 2 was produced. Here, dimensional parameters of the piezoelectric element were set so that the piezoelectric element had a pitch of 85 μm, a width of 46 μm, a length of 750 μm, and a thickness of 2 μm. Dimensional parameters of the pressurization chamber 70 were set so that the pressurization chamber 70 had a width of 60 μm, a chamber length of 800 μm, and a chamber depth of 55 μm.

For the piezoelectric element structure obtained, the upper electrode side was set to a positive potential and the lower electrode side was set to a negative potential (earth potential). Polarization processing was performed on the piezoelectric element structure at an applied voltage of 40 V. In the polarization processing, the voltage was slowly raised from 0 V for three minutes, kept at a raised value for one minutes, and slowly lowered to 0 V. After the polarization processing, the piezoelectric element was driven with the following drive conditions. The amount of displacement at a center portion of the piezoelectric element was measured with a laser interferometer (to output a distance between two points). A measurement point was a center of an element portion. Assuming that the position of the center of the element portion at rest was zero, the amount of displacement was 0.223 μm. Note that the amount of displacement is obtained from an initial state, in the present embodiment, an initial value at a stable point after energization.

[Drive Conditions of Element]

Applied voltage: DC and 0 to 30 V (with the upper electrode at a positive potential)

Application cycle: 100 kHz

<Triangular Wave Shape>

To examine variations in the amount of displacement, an element was produced under the same conditions as the conditions of Example 1 and the amount of displacement of the element was obtained. The amount of displacement was in a range of 0.212 to 0.219 μm. The variations in the amount of displacement derive from variations of elements produced under the same conditions. Even if the elements are produced under the same conditions, slight variations arise in, for example, the accuracy of processing liquid chambers, the accuracy of the thickness of the diaphragm plate, and the accuracy of the size of each element as an actuator.

Finally, the PZT-film laminated structure obtained was analyzed with the SIMS. The analyser and conditions are as follows.

[Analyser and Conditions]

Measurement device: CAMECAIMS-7f

<Magnetic-Field-Type SIMS>

Primary ion type: Cs+

Primary acceleration voltage: 15.0 kV

Detection area: 30 (μm φ)

Results of the SIMS analysis of a PZT portion are illustrated in FIG. 11. As illustrated in FIG. 11, in both Ti and Cl, waviness was observed at interfaces of laminated films and diffusion of components due to heat treatment was observed. The values obtained were summed for the entire PZT film and the ratio of the secondary ion intensity of each of Ti and Cl was calculated. As a result, the ratio of the total value of the secondary ion intensity of Cl to the total value of the secondary ion intensity Ti (the total value of the secondary ion intensity of Cl/the total value of the secondary ion intensity of Ti) was 0.00998. Note that, in the descriptions below, the ratio of the total value of the secondary ion intensity of Cl to the total value of the secondary ion intensity Ti may be represented by, simply, Cl/Ti.

Here, regarding the accuracy of measurement values of the SIMS, the secondary ion intensity may be different between the magnetic-field type and the Quadrupole type. However, comparing SIMSs of the same magnetic-field type, the inventors confirmed that measurement results were consistent if the production conditions were constant.

Example 2

The same procedure as the procedure in Example 1 was performed using a sol-gel liquid in which the amounts of impurities have changed without changing the composition amounts of main ingredients of Ti, Zr, and Pb of the sol-gel liquid. When SIMS analysis was performed on a film obtained similarly with the film of Example 1, Cl/Ti was 0.0113. Using the film, a liquid discharge head was produced in the same manner as the manner of Example 1. When the measurement was performed on the film in the same manner as the measurement of Example 1, the amount of displacement was 0.220 μm.

Example 3

The same procedure as the procedure in Example 1 was performed using a sol-gel liquid in which the amounts of impurities have changed without changing the composition amounts of main ingredients of Ti, Zr, and Pb of the sol-gel liquid. When the SIMS analysis was performed on a film obtained similarly with the film of Example 1, Cl/Ti was 0.030. Using the film, a liquid discharge head was produced in the same manner as the manner of Example 1. Thus, when three liquid discharge heads were produced under the same conditions, the amount of displacement was in a range of 0.213 to 0.223 m. The average value of the amount of displacement was 0.218 μm, and the range of variations was 0.05 rm.

Example 4

The same procedure as the procedure in Example 1 was performed using a sol-gel liquid in which the amounts of impurities have changed without changing the composition amounts of main ingredients of Ti, Zr, and Pb of the sol-gel liquid. When the SIMS analysis was performed on a film obtained similarly with the film of Example 1, Cl/Ti was close to 0.02. Using the film, a liquid discharge head was produced in the same manner as the manner of Example 1. Thus, when three liquid discharge heads were produced under the same conditions, the amount of displacement was in a range of 0.219 to 0.223 μm.

Comparative Example 1

The PZT-film laminated structure was produced in the same manner as the manner of Example 1 except that a sol-gel liquid containing a greater amount of chlorine was used as a raw material. When the PZT-film laminated structure obtained was evaluated, the PZT-film had a main orientation in PZT (100) (the orientation rate of PZT (100) was 95% or greater). When the peak of PZT (200) was evaluated, the peak position was shifted to a greater side by 0.02 or greater by 20 than the peak position of PZT (200) in Example 1. In other words, the inventors found that the orientation rate of PZT (100) in Comparative Example 1 was similar to the orientation rate of PZT (100) in Example 1, and however, more crystal strain occurred in Comparative Example 1 than in Example 1.

Figure 12:
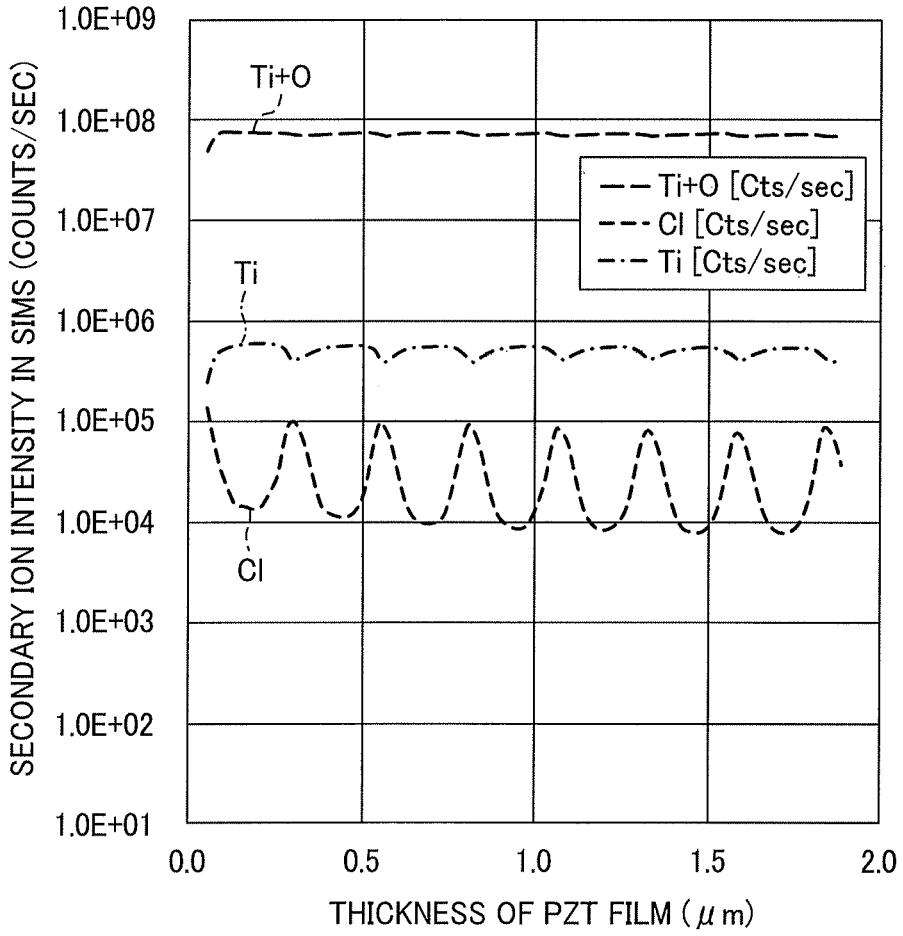
FIG. 12 is a graph of results of SIMS analysis of the PZT film in Comparative Example 1.

Results of analysis of the content of chlorine with the SIMS were illustrated in FIG. 12. Here, Cl/Ti was 0.064. Note that the ratio of the secondary ion intensity was performed in the same method as the method in Example 1. When the amount of displacement of the piezoelectric element was measured in the same manner as in Example 1, the amount of displacement was 0.18 μm, which was a smaller value than the values in Examples 1 to 4.

Comparative Example 2

The same procedure as the procedure in Example 1 was performed using a sol-gel liquid in which the amounts of impurities have changed without changing the composition amounts of main ingredients of Ti, Zr, and Pb of the sol-gel liquid. Comparative example 2 is prepared to obtain additional data of critical point. Six samples were prepared with different amounts of impurities. When SIMS analysis was performed on a film obtained similarly with the film of Example 1, the values of Cl/Ti of all samples were greater than 0.030. When the amounts of displacement of the six samples were measured, the amounts of displacement were in a range of 0.182 to 0.196 μm.

Comparative Example 3

The same procedure as the procedure in Example 1 was performed except that the orientation control layer was not formed. For the PZT obtained in Comparative Example 3, since PZT (111) of the lower electrode acts as a reference as a base layer of crystal growth, a PZT (100) main orientation or a PZT (001) main orientation is not obtained. A PZT (111) main orientation is obtained and the ratio of the peak intensity of PZT (111) was 90% or greater. When the amount of displacement was measured in the same manner as in Example 1, the amount of displacement was in a range of 0.15 to 0.18 μm.

Comparative Example 4

The same procedure as the procedure in Example 1 was performed to form the PZT film except that the baking temperature condition was set out of a proper range. In the PZT film, the peak intensity of PZT (100) or the peak intensity of PZT (001) is lower than 90% relative to the peak intensity of all PZT peaks. When the amount of displacement of the PZT film was measured in the same manner as in Example 1, the maximum amount of displacement was 0.223 μm, which is equivalent to the value of Example 1. However, variations in the amount of displacement increased between wafers and lots, which were a level at which practical use would be hampered.

Figure 13:
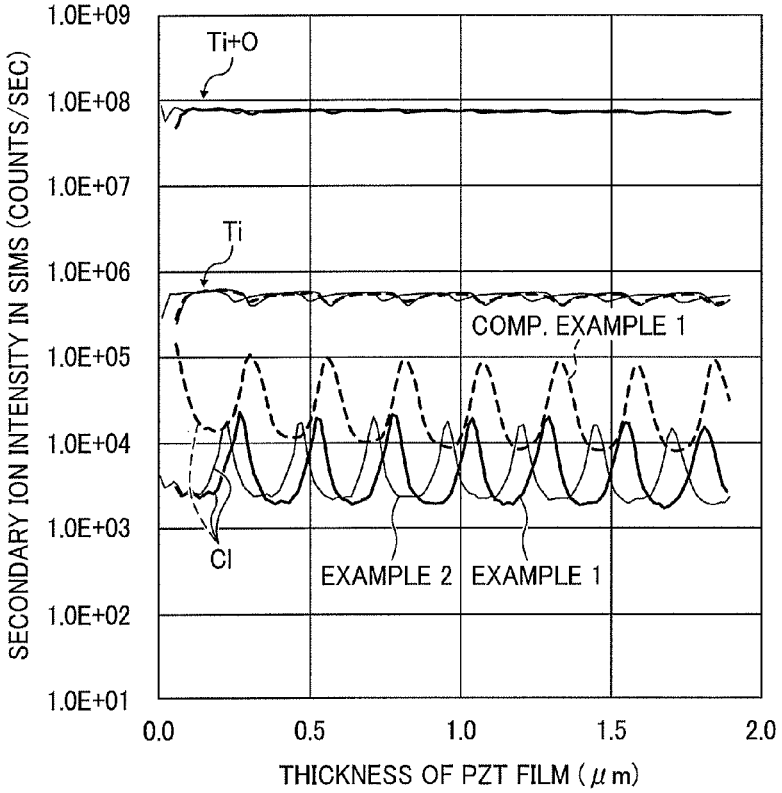
FIG. 13 is a graph in which results of SIMS analysis of Example 1, Example 2, and Comparative Example 1 are overlapped.

The above-described results are considered below. For comparison, measurement results of Example 1, Example 2, and Comparative Example 1 (Comp. Example 1 in FIG. 13) with the SIMS are illustrated in FIG. 13. In FIG. 13, the secondary ion intensity of Ti is adjusted to take the same position between Example 1, Example 2, and Comparative Example 1 for comparison. As illustrated in FIG. 3, the secondary ion intensity of Cl was greater in Comparative Example 1 than in each of Example 1 and Example 2. Accordingly, Cl/Ti was smaller in each of Example 1 and Example 2 and greater in Comparative Example 1.

Figure 14:
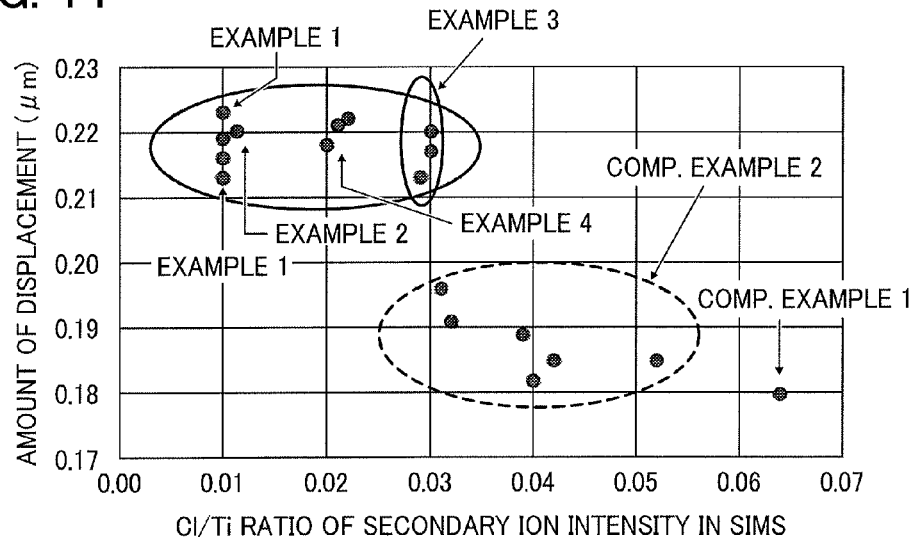
FIG. 14 is a graph of relationships between the ratio of the secondary ion intensity of Cl/Ti in SIMS and the amount of displacement.

Relationships between the amount of displacement and Cl/Ti obtained from Examples 1 to 4 and Comparative Examples 1 and 2 are illustrated in FIG. 14. As illustrated in FIG. 14, Example 1 had four points of Cl/Ti=0.0998, Example 2 had one point of Cl/Ti=0.0113, Example 3 had two points of Cl/Ti=0.030 and one point of Cl/Ti=0.029. Example 4 had three points of Cl/Ti being close to 0.02.

As illustrated in FIG. 14, when Cl/Ti in SIMS was not greater than 0.03, preferable displacement amounts were obtained. However, when Cl/Ti in SIMS was greater than 0.03, preferable displacement amounts were not obtained. Note that, as seen from FIG. 14, variations in the amount of displacement occurred even when Cl/Ti was the same (for example, Examples 1 and 3). However, more variations in the amount of displacement occurred when the concentration of chlorine was changed and when Cl/Ti was changed (Comparative example 2) than when Cl/Ti was the same.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A PZT-film laminated structure, comprising:

a substrate;

a lower electrode disposed on the substrate;

an orientation control layer disposed on the lower electrode;

a PZT layer disposed on the orientation control layer; and an upper electrode disposed on the PZT layer, the PZT layer having a (100) or (001) main orientation in which a peak intensity of PZT (100) or (001) is 90% or greater relative to a peak intensity of all PZT peaks in an X-ray diffraction measurement, and a ratio of a total value of a secondary ion intensity of Cl relative to a total value of a secondary ion intensity of Ti in the PZT layer being equal to or smaller than 0.03 when the secondary ion intensity of Cl and the secondary ion intensity of Ti in the PZT layer are measured in a direction of thickness of the PZT layer with a magnetic-field secondary ion mass spectrometry.

2. The PZT-film laminated structure according to claim 1, wherein the orientation control layer includes titanium oxide or lead titanate.

3. A liquid discharge head comprising:

a nozzle substrate having a nozzle orifice to discharge liquid;

a channel forming substrate including a pressurization chamber communicated with the nozzle orifice;

a diaphragm plate constituting at least one wall of the pressurization chamber; and a piezoelectric thin-film element including the PZT-film laminated structure according to claim 1 disposed on the diaphragm plate.

4. A liquid discharge device comprising the liquid discharge head according to claim 3.

5. The liquid discharge device according to claim 4, wherein the liquid discharge head is integrated as a single unit with at least one of:

a head tank to store liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

6. A liquid discharge apparatus comprising the liquid discharge device according to claim 4, to discharge the liquid.

7. A liquid discharge apparatus comprising the liquid discharge head according to claim 3, to discharge the liquid.

* * * * *